US005575680A

United States Patent [19]

Suffi

[11] Patent Number: 5,575,680

[45] Date of Patent: Nov. 19, 1996

[54] INSULATION DISPLACEMENT CONNECTOR AND BLOCK

[75] Inventor: Louis Suffi, Westchester, Ill.

[73] Assignee: Reliance Com/Tec Corporation, Franklin Park, Ill.

[21] Appl. No.: 388,401

[22] Filed: Feb. 14, 1995

[51] Int. Cl.[6] ..... H01R 4/24

[52] U.S. Cl. ..... 439/404; 439/885; 439/402

[58] Field of Search ..... 439/395–404, 439/885, 607

[56] References Cited

U.S. PATENT DOCUMENTS

| | | | |
|---|---|---|---|
| 3,957,335 | 5/1976 | Troy | 339/125 R |
| 5,127,845 | 7/1992 | Ayer et al. | 439/395 |
| 5,145,401 | 9/1992 | Archer | 439/395 |
| 5,269,700 | 12/1993 | Mitra | 439/395 |

*Primary Examiner*—David L. Pirlot

*Attorney, Agent, or Firm*—Trexler, Bushnell, Giangiorgi & Blackstone, Ltd.

[57] ABSTRACT

An insulation displacement connector comprises a single-piece unitary connector body formed from a relatively thin, generally flat of electrically conductive material having a base portion and two pairs of resilient, wire-engaging arms projecting from one side of the base portion. Each of the pairs of arms define therebetween a wire-receiving slot configured for displacing insulation from a wire introduced therebetween and for gripping the wire. Each of the pairs of arms also defines a tool-engaging portion of a predetermined configuration for engagement by a tool for connecting a wire to the wire-receiving slot. The base portion and the pairs of resilient arms define a pair of opposed, parallel generally flat surfaces. At least one cutout is defined on the connector body for reducing the total area of these flat surfaces while maintaining the predetermined configuration of the tool-engaging portions. The invention includes a method for making such a connector and a connector terminal block employing a plurality of connectors of this type.

8 Claims, 1 Drawing Sheet

INSULATION DISPLACEMENT CONNECTOR AND BLOCK

BACKGROUND

This invention relates to a novel and improved insulation displacement connector and terminal block which meet high frequency transmission requirements while presenting the same external dimensions and configuration as existing connectors and terminal blocks.

Insulation displacement connectors and terminal blocks which utilize such connectors have found widespread acceptance in communications applications. Such connectors and terminal blocks have been utilized primarily in telecommunications applications. Examples of particularly useful and widely accepted terminal blocks and associated insulation displacement connectors are shown in U.S. Pat. Nos. 3,957,335, issued May 18, 1976 to Troy and 5,127,845, issued Jul. 7, 1992 to Ayer et al., which are assigned to the same owner as the present invention.

Such blocks and connectors may be used as a connecting point, splice point or cross-connect point of a communications network. Such communications networks can be utilized for voice communications and data communications. In the case of data communications, the speed of data transmission is usually much higher today than only a few years ago. More recently, a number of new standards have been developed by the industry standards organizations to assure reliability and integrity of transmissions.

These new standards have been developed for communications networks including both cables and connecting devices for supporting data communications at relatively high frequencies. These standards specify acceptable transmission characteristics of both cables and connecting devices for data transmission at frequencies of up to 100 Mhz.

The terminal blocks of the above-referenced patents present rows of terminals arranged in parallel and spaced apart in groups. Each group has a plurality of side-by-side terminals. The spacing between terminals in each group as well as between the respective groups is preselected for allowing easy access by a tool for connecting wires to the respective terminals. This tool, and a corresponding projecting tool-engaging portion of each insulation displacement connector or terminal are of complementary configuration. This arrangement is advantageous in that a single standardized tool can be used in the field to connect wires to a terminal block of this type.

Moreover, the external configuration and dimensions of the terminal block itself are preferably standardized, such that one block can be substituted for another block in the field. This avoids the tasks of rearranging equipment, providing additional or different mounting space, and moving or replacing mounting hardware or the like. This also maintains the same dimensional relationships between one or more terminal blocks and adjacent related equipment.

The above-mentioned standards for high frequency (e.g. 100 Mhz.) data transmission impose various transmission requirements on both the wiring and connecting equipment such as terminal blocks of the foregoing type. These standards have been developed by such organizations as The American National Standard Institute (ANSI), Electronic Industries Association (EIA), Telecommunications Industry Association (TIA). The current standards are designated EIA/TIA 568, July 1991, and Telecommunications Systems Bulletin (TSB) 40-A, January 1994. In order to meet these requirements, various modifications have been proposed both to the prior art terminal blocks and to the prior art insulation displacement connectors to be mounted therein.

Advantageously, we have discovered a manner in which to effect such modifications as are necessary to meet the requirements imposed by the high-frequency standards without changing either the tool-engaging portion of the insulation displacement connector or the external dimensions and configuration of the terminal block, including the terminal spacing thereon.

OBJECTS AND SUMMARY

Accordingly, a general object satisfied by the present of this invention to provide a novel and improved insulation displacement connector and terminal block which will meet the requirements for data transmissions at 100 Mhz.

A related object satisfied by the present invention is to provide a novel and improved insulation displacement connector in accordance with the foregoing object without modifying a tool-engaging portion of the connector, such that existing tools can be used to connect wires to the connector.

A further related object satisfied by the present invention is to provide a terminal block which maintains the spacings between individual connectors or terminals and also maintains the external configuration and dimensions of existing terminal blocks, so as to allow direct replacement of existing terminal blocks in the field.

Briefly and in accordance with the foregoing, the present invention envisions an insulation displacement connector having a single-piece unitary connector body formed from a relatively thin, generally flat portion of electrically conductive material. The connector has a base portion and two pairs of resilient, wire-engaging arms projecting from one side of the base portion. Each of the pairs of arms define therebetween a wire-receiving slot configured for displacing insulation from a wire introduced therebetween and for gripping the wire. Each of the pairs of arms also defines a tool-engaging portion of a predetermined configuration for engagement by a tool for connecting a wire to the wire-receiving slot. The base portion and the pairs of resilient arms define a pair of opposed, parallel generally flat surfaces. At least one cutout is defined on the connector body for reducing the total area of these flat surfaces while maintaining the predetermined configuration of the tool-engaging portions. The invention extends to a method for making such a connector and to a connector terminal block employing a plurality of connectors of this type.

In accordance with another aspect of the invention, an insulation displacement connector terminal block is provided comprising an elongated terminal block body formed of an electrical insulator material. The terminal block has predetermined external dimensions and a plurality of rows of connector-receiving openings arranged in parallel and spaced-apart groups of side-by-side through openings with predetermined spacing between the groups. A plurality of insulation displacement connectors are mounted in the terminal blocks, each connector having a base portion and two pairs of resilient, opposed wire-engaging arms projecting from one side of said base portion. Each of the pairs of arms define a wire-receiving slot therebetween and are configured for gripping and displacing insulation from a wire placed in the slot. A tool-engaging portion of each of the pairs of arms is provided having a predetermined configuration for engagement by a tool for positioning a wire in the wire-receiving slot. The base portion and resilient arms define a pair of opposed, parallel generally flat surfaces. Each of the pairs of wire-engaging arms projects through a corresponding through opening in the terminal block body, such that the flat surfaces of the plurality of insulation displacement connectors are parallel and spaced apart from each other. Additionally, the insulation displacement connector is configured to enhance transmission characteristics for reducing the near-end crosstalk of the insulation displacement connector terminal block, while maintaining the external dimensions of the terminal block and the spacing between groups of side-by-side connector-receiving openings in the terminal block.

In accordance with yet another aspect of the invention, a method of forming an insulation displacement connector is provided comprising forming a connector body as a one-piece unitary body from a relatively thin, flat portion of electrically conductive material. A base portion and two pairs of resilient wire-engaging arms are formed on the formed connector body with the arms projecting from one side of the base portion. The base portion and said resilient arms define a pair of opposed, parallel generally flat surfaces with each of the pairs of arms defining a tool-engaging portion of a predetermined configuration for engagement by a tool for connecting a wire to the wire-receiving slot. A wire-receiving slot is formed between each of the pairs of arms and configured for displacing insulation from a wire and for gripping a wire between the arms. The total area of the opposed, parallel flat surfaces of the connector is reduced while maintaining the predetermined configuration of the tool-engaging portions.

BRIEF DESCRIPTION OF THE DRAWINGS

The features of the present invention which are believed to be novel are set forth with particularity in the appended claims. The organization and manner of operation of the invention, together with further objects and advantages thereof may best be understood by reference to the following description, taken in connection with the accompanying drawings in which like reference numerals identify like elements, and in which:

DETAILED DESCRIPTION OF THE ILLUSTRATED EMBODIMENT

Figure 1:
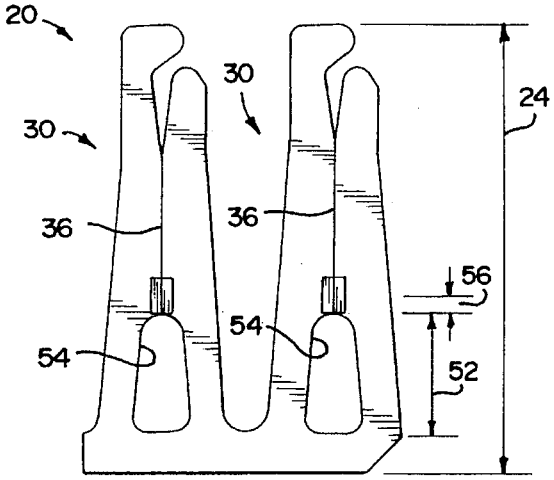
FIG. 1 PRIOR ART
FIG. 1 is an enlarged, side elevational view of an insulation displacement connector in accordance with the prior art.

With reference to the figures, FIG. 1 has been provided for purposes of contrasting the present invention from known devices. FIG. 1 shows an insulation displacement connector 20 as generally shown in U.S. Pat. No. 5,127,845, issued Jul. 7, 1992 to Ayer et al., and which is assigned to the assignee of the present invention. The improved insulation displacement connector 22 of the present invention has been illustrated in generally the same scale as the prior art insulation displacement connector 20 so as to further highlight the distinctions between these two devices. With general reference to FIGS. 1 and 2, it can be seen that both IDCs 20, 22 have generally the same vertical dimension (as indicated by reference numeral 24). The overall outside dimensions which are critical to mounting in a terminal block 26 (see FIG. 3) are generally equivalent so that the improved IDC 22 of the present invention can be retrofitted into the same terminal block 26 which currently use the prior art IDCs 20 and to make these changes using the available existing tool.

While the prior art IDC 20 performs well and meets the applicable TIA specification TIA 568, Level 4 transmission requirements for 20 MHz frequency, it does not satisfy the minimum specified attenuation and crosstalk requirements to satisfy the TIA 568 specification for Level 5 transmission requirements for 100 MHz frequency. As such, the inventor has thoroughly studied and analyzed the prior art IDC 20 in the interest of improving the IDC to achieve the Level 5 category specification. In the study and analysis, one of criteria was to provide an IDC 22 which maintains the general mechanical structure of the prior art IDC 20, thus allowing interchangeability of the two components.

Figure 2:
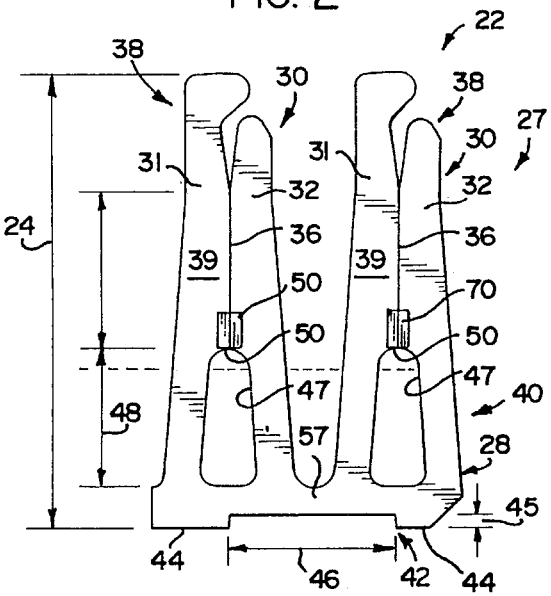
FIG. 2 is an enlarged, side elevational view of an insulation displacement connector in accordance with the present invention having enlarged through openings.

With further reference to FIG. 2, the improved IDC 22 is coined or formed as a single-piece unitary body 27 which includes a base portion 28 and two pairs of resilient, wire engaging arms 30 protruding from the base 28. Each pair of arms 30 includes a first arm 32 and a second arm 34. The first and second arms 32, 34 define a wire-receiving slot 36 which is configured for gripping and displacing insulation from wire positioned between the first and second arms 32, 34. Each pair of arms 30 further include a tool engaging portion 38 which has the same general configuration as the prior art IDC 20 in order to assure compatibility with existing tools. The body 27 has generally flat parallel, symmetric side 39, the surfaces of which define the area of the IDC 22, the importance of which will be described in greater detail hereinbelow.

The primary improvement in the improved insulation displacement connector 22 of the present invention is the transmission enhancement means or cutout-defining means 40. It has been found, as will be described in greater detail herein below, that alteration of the shape of the IDC in a specific and strategic pattern to change the area of the IDC results in an IDC with improved transmission characteristics. In fact, the improvements in the transmission characteristics have been designed to produce transmission characteristics which meet the Level 5 category at 100 MHz frequency.

The transmission enhancement means 40 includes an opening 42 defined in the base 28. The opening 42 is defined in the illustrated embodiment as a generally rectangular cut-out or notch formed in a foot 44 of the base 28. The opening 42 extends inwardly from the surface of the foot 44 a width dimension 45 of approximately 0.02 inches and extends generally intermediate between the pairs of arms 30, 30 a length dimension 46 of approximately 0.3 inches. The opening 42 is one component of the transmission enhancement means 40 which reduces the total area of the IDC 22 surface while maintaining the predetermined configuration and the structural integrity of the IDC 22.

With further reference to FIG. 2, the first and second arms 32, 34 define a through aperture 47 extending a dimension 48 measured between the base 28 and an end 50 of the wire receiving slot 36. When compared to a comparable dimension 52 of a through aperture 54 of the prior art IDC 20, it can be seen that the dimension 48 of the improved IDC 22 is greater than the dimension 52 of the prior art IDC 20 by a lengthened portion 56. This lengthened through aperture dimension 56 further reduces the total area of the improved IDC 22 while maintaining the predetermined configuration and structural integrity of the IDC. The lengthened dimension 56 is a portion of the arms 32, 34 which would have defined a portion of the wire-receiving slot 36. In the improved IDC 22, the wire-receiving slot 36 is shortened by a dimension equal to the lengthened portion 56 when compared to the prior art IDC 20.

Figure 5:
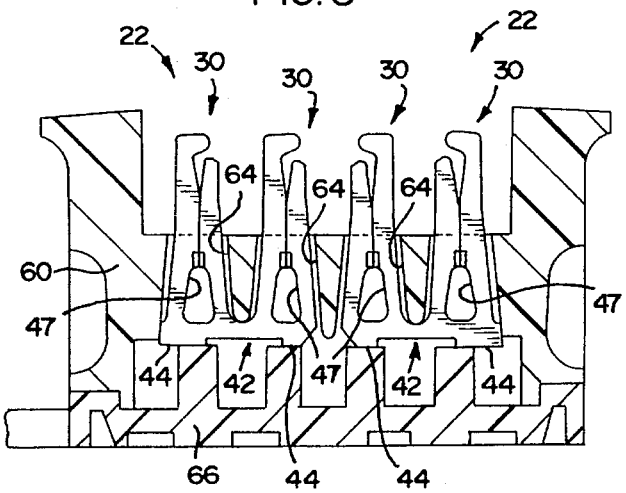
FIG. 5 is an enlarged, partial fragmentary cross-sectional upwardly directed, plan view taken through the terminal block generally along the line 5—5 of FIG. 3.

Up to this point a description of the structural features of the improved IDC 22 have been discussed. In order to more fully understand the substantial nature of the improvements resulting from the structural features, a more thorough description of the electrical characteristics resulting from the improvements should be provided. As noted above, the improved IDC 22 improves the transmission characteristics thereby improving the crosstalk transmission output from pair to pair. Crosstalk coupling, such as induced in a terminal block 28, is produced by electro magnetic coupling between physically isolated circuits such as the parallely aligned IDC. The plastic insulation between neighboring IDC connectors 22 isolate the IDS, however, the IDCs in the block act as capacitor plates (see FIG. 5). Coupling is caused by near-field effect which can be represented by mutual inductance and direct capacitance.

The near-field effect depends on the relative magnitude of the capacitance imbalance between circuits, mutual inductance between both circuits, and the characteristic impedance of both circuits. When mathematically considered, near-field effect or near end crosstalk (also known as NEXT) can be represented as follows:

$$\text{NEXT} = \left[ \frac{i_c - i_m}{i_o} \right] = w^2 \left[ \frac{z_o c_u}{8} + \frac{M}{2z_o} \right]^2$$

AS such it can be seen that the effect of NEXT depends on the relative magnitude of $c_u$ (capacitance imbalance between both circuits), M (mutual inductance between both circuits), and $z_o$ (characteristic impedance of both circuits). It should also be noted that the capacitance imbalance between the circuits can be represented as follows:

$$C_u = \epsilon \frac{A}{d}$$

As such the capacitance imbalance ($C_u$) can be reduced if the area (A) can be reduced. If the capacitance imbalance ($C_u$) can be reduced by a reduction in the area (A), the NEXT is reduced. As such, by reducing the area (A) of the IDC, which is in effect a capacitor plate when mounted with a plurality of IDCs in the terminal block 26, the NEXT characteristics of the block are improved a sufficient degree to meet the requirements for the specified TAI '568 category 5 criteria.

The area of the IDC 22 has been reduced by analysis of the IDC for electrical and structural characteristics. The transmission enhancement means 40, including the opening 42 and lengthened (56) through opening 47, result in a reduction of the area of the IDC 22. The configuration and placement of opening 42 and the lengthened (56) through opening 47 maintain the structural characteristics of the IDC 22. Placement of the opening 42 between neighboring pairs of arms 30, 30 and on the opposite side of the base 28 from the arms 30, 30 preserves a bridging portion 57 between the neighboring pairs of arms 30, 30. Additionally, the lengthen (56) through opening 42 further reduces the area of the IDC 22 yet preserves a sufficient portion of the arms 31, 32 defining the slot 36 so that the IDC 22 provides the same insulation removing and wire connecting function as the prior art IDC 20.

Figure 3:
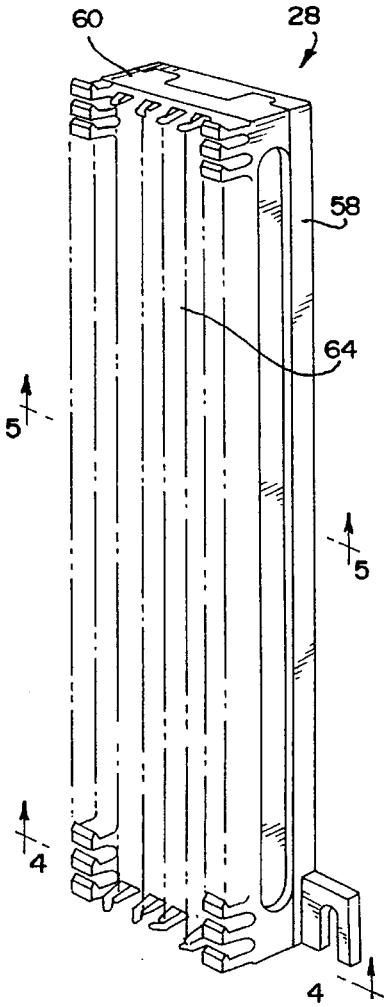
FIG. 3 is a perspective view of an assembled terminal block in accordance with the present invention.
Figure 4:
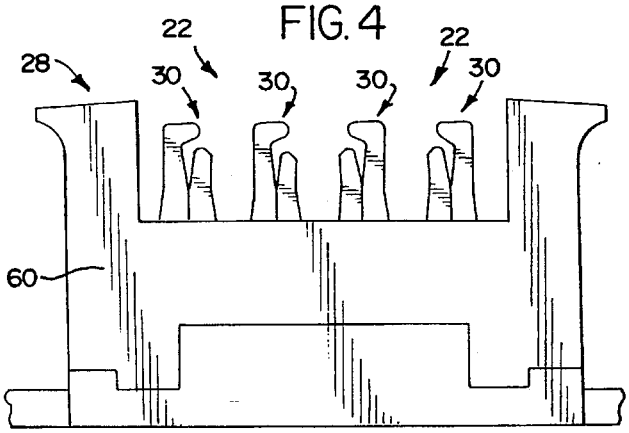
FIG. 4 is an enlarged, upwardly directed, plan view of the terminal block taken generally along the line 4—4 of FIG. 3.

Referring to FIG. 3, the terminal block 28 includes a dielectric body portion 58 having a central section 60 and a pair of opposed fanning strips 62 along the lengths of the longitudinal margins of the central section 60. Formed in the central section 60 are a plurality of rows of side-by-side holes 64 which are in the form of narrow slots. These holes or slots are disposed in the central section in a generally, matrix-like pattern of rows and columns positioned in each hole or slot is the electrically conductive insulation displacement connector 22. The arms 30, 30 of an IDC 22 are located between the fanning strips 62 so that individual conductors or wires from a cable can be broken out from the cable, passed through the fanning strips and thus be gutted into connection with a desired IDC 22.

The IDCs are retained in the terminal block 28 in accordance with the teachings as set forth in U.S. Pat. No. 5,127,845 issued Jul. 7, 1992 to Ayer et al., which is incorporated herein by reference to support the mounting of the IDCs 22 in the terminal block 28.

The present invention also teaches a method of forming the IDC 22. The method includes forming a body 68 as a single-piece unitary component from a relatively thin, generally flat portion of electrically conductive material. The body 68 is formed with the base 28 and two pairs of bifurcated arms 30 projecting from one side of the base 28. Each pair of arms 30 include the first arm 32 and the second arm 34 which define a wire-engaging slot 36 therebetween. The tool engaging portion 38 is defined by the configuration of the first and second arms 32, 34. The wire-receiving slot 36 is formed by dividing the portion of the body 68 forming an arm 30 to define the first and second arms 32, 34. Additionally, the through apertures 47 are formed by removing a portion of the body 68 in an enlarged open area between the first and second arms, 32, 34. The opening 42 is formed in the base 28 generally opposite the side from which the arms 30, 30 extend from the base 28. Wire-engaging features 70 are formed between an upper portion of the through aperture 47 along the wire-receiving slot 36 in order to more positively engage the outer surface of a wire placed in the wire-receiving slot 36.

While a particular embodiment of the invention has been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. An insulation displacement connector comprising: a single-piece unitary body formed from a relatively thin, flat electrically conductive material having a base portion, and two pairs of resilient, wire-engaging arms protruding from said base portion, each of said two pairs of arms defining therebetween a wire-receiving slot configured for displacing insulation from a wire positioned therebetween and for gripping and conductively engaging a conductor of said wire, said two pairs of arms further defining a tool-engaging portion for engagement by a tool for inserting a wire into said wire-receiving slot; and a foot of said base portion positioned oppositely said tool-engaging portions, said foot defining an opening therein extending inwardly in said base towards said tool-engaging portions whereby said opening reduces the dimension of said base portion for improving transmission characteristics of said insulation displacement connector.

2. An insulation displacement connector as recited in claim 1, wherein each of said two pairs of arms define therebetween a through-aperture extending between said base and said wire-receiving slot.

3. An insulation displacement connector according to claim 1, wherein said two pairs of arms extend from one side of said base portion, each of said two pairs of arms defining a through-aperture extending between said base and said wire-receiving slot, said opening defined in said base portion on a side of said base portion opposite said two pairs of arms, said opening being positioned generally intermediate said through-apertures.

4. An insulation displacement connector block comprising: an elongated terminal block body formed of an electrical insulator material having predetermined external dimensions and a plurality of rows of connector-receiving openings arranged in parallel and spaced-apart groups of side-by-side through-openings with predetermined spacing between said groups; a plurality of insulation displacement connectors, each connector comprising a base portion and at least two pairs of resilient, opposed wire-engaging arms projecting from said base portion, each of said pairs of arms defining therebetween a wire-receiving slot configured for displacing insulation from a wire introduced therebetween and for gripping and conductively engaging a conductor of said wire, said two pairs of arms further defining a tool-engaging portion for engagement by a tool for inserting a wire into said wire-receiving slot; and a foot of said base portion positioned oppositely said tool-engaging portions, said foot defining an opening therein extending inwardly in said base towards said tool-engaging portions; wherein each of said pairs of arms projects through one of said through openings of said terminal block body, such that said flat surfaces of said plurality of insulation displacement connectors are parallel and spaced apart from each other; and whereby said opening reduces the dimension of said base portion for reducing the near-end crosstalk of said insulation displacement connector terminal block while maintaining the external dimensions of said terminal block and the spacing between groups of side-by-side connector-receiving openings therein.

5. An insulation displacement connector block as recited in claim 4, wherein each of said two pairs of arms define therebetween a through aperture extending between said base and said wire-receiving slot.

6. An insulation displacement connector block as recited in claim 4, wherein each of said two pairs of wire-engaging arms defines therebetween a through aperture extending between said base and said wire-receiving slot, said opening defined in said base portion on a side of said base portion opposite said two pairs of arms, said opening being positioned generally intermediate said foot.

7. A method for forming an insulation displacement connector comprising: forming a connector body as a one-piece unitary body from a relatively thin, generally flat portion of electrically conductive material; forming on said connector body a base portion and pairs of resilient wire-engaging arms projecting from one side of said base portion, such that said base portion and said pairs of arms define a pair of opposed, parallel generally flat surfaces and such that each of said pairs of arms defines a tool-engaging portion of a predetermined configuration for engagement by a tool for connecting as wire to said wire-receiving slot; forming between each of said pairs of arms a wire-receiving slot configured for displacing insulation from a wire and for gripping a wire between said arms; and providing a notch in a foot of said base generally opposite said wire-engaging arms, said notch extending inwardly in said base towards said wire-engaging arms, said notch reducing the dimension of said base portion for improving transmission characteristics of said insulation displacement connector.

8. A method for forming an insulation displacement as recited in claim 7, further comprising the step of: forming between each of said pairs of arms a through aperture extending between said base and said wire-receiving slot.

* * * * *